US005463931A

United States Patent [19]

Karlsson et al.

[11] Patent Number: 5,463,931

[45] Date of Patent: Nov. 7, 1995

[54] CONTROLLER FOR A HYDRAULIC MOTOR

[75] Inventors: Hans B. Karlsson, Göteborg; Lennart E. Fellinger, Fritsla; Axel T. Micael, Floda, all of Sweden

[73] Assignee: Voac Hydraulics Boras AB, Boras, Sweden

[21] Appl. No.: 270,388

[22] Filed: Jul. 5, 1994

[30] Foreign Application Priority Data

Jul. 7, 1993 [SE] Sweden ..... 9302347-1

[51] Int. Cl.[6] ..... F15B 11/08; F15B 13/04

[52] U.S. Cl. ..... 91/428; 91/459; 91/461

[58] Field of Search ..... 91/461, 459, 428, 91/527, 529

[56] References Cited

U.S. PATENT DOCUMENTS

| | | | |
|---|---|---|---|
| 3,589,242 | 6/1971 | Peterson | 91/527 X |
| 3,788,425 | 1/1974 | Balogh | 91/529 X |
| 4,072,169 | 2/1978 | Heiser et al. | 91/461 X |
| 4,350,209 | 9/1982 | O'Connor | 91/461 X |
| 4,644,846 | 2/1987 | Kozuka | 91/461 X |

FOREIGN PATENT DOCUMENTS

| | | | |
|---|---|---|---|
| 0127103 | 8/1982 | Japan | 91/461 |

*Primary Examiner*—Edward K. Look
*Assistant Examiner*—Hoang Nguyen
*Attorney, Agent, or Firm*—Frishauf, Holtz, Goodman, Langer & Chick

[57] ABSTRACT

A controller for a hydraulic motor (11) comprises a directional valve (12) for communicating hydraulic pressure fluid from a pressure source (10) to the motor (11), a pilot pressure operated activating device (13, 14), pilot valves (17, 18) connected to the activating device (13, 14) and to the pressure source (10), and a manually operable activating lever (15) mechanically connected to the directional valve (12) via a coupling (24, 55, 56). A pressure fluid operated actuator (25, 47, 48) is associated with the coupling (24, 55, 56) to shift the coupling when pressurized from an engaged condition and a disengaged condition, and a mode shifting valve (19) is connected both to the actuator (25, 47, 48) and to the pilot valves (17, 18) and is arranged to pressurize simultaneously the pilot valves (17, 18) and the actuator (25, 47, 48) of the coupling (24, 55, 56) to avoid double activation of the directional valve (12).

5 Claims, 2 Drawing Sheets

CONTROLLER FOR A HYDRAULIC MOTOR

BACKGROUND OF THE INVENTION

This invention relates to a controller for controlling the operation of a hydraulic motor.

In particular, the invention concerns a hydraulic motor controller comprising a directional valve for communicating pressure fluid from a pressure source to the motor, and including pilot pressure operated activating means, pilot valves connected to said activating means and to the pressure source, and a manually operable activating means mechanically connected to the directional valve via a coupling means.

A problem inherent in hydraulic motor controller of the above type, which comprises both pilot pressure operated activating means and a manually operable activating means, is the risk for unintentional or accidental activation of the directional valve by the pilot pressure activating means while controlling the motor operation by the manual activating means, or vice versa. In crane or excavator applications, which are the most common applications for this type of control system, accidental double activation of one or more directional valves would cause undesired and unexpected movements of crane or excavator arms which would be hazardous to personnel and equipment.

In previous control systems of this type several more or less successful attempts have been made to avoid undesirable activation by means of the control lever while the system is operated by remote control via the pilot valves and the pilot pressure activating means on the directional valve.

One such attempt comprises the application of a kind of hood which is intended to cover the activating lever or levers when the remote control is used, and which is coupled to a safety stop switch for inhibiting operation of the system via the remotely controlled pilot valves as the hood is removed from the lever or levers.

Another previously suggested way to avoid accidental activation of the directional valve by the control lever comprises a position detecting means coupled to the valve spindle of the directional valve and arranged to cause activation of a safety stop circuit if there is a discrepancy between the actual position of the valve spindle and a position the valve spindle should occupy at a certain pressure drop.

A third way previously suggested to solve the problem of how to prevent double activation of the directional valve was simply that the control lever or levers are arranged to be removed from the valve as remote control is performed.

The main object of the invention is to improve safety of hydraulic motor controller of the above described type by employing means by which double activation of the directional valve is safely avoided.

Another object of the invention is to provide a hydraulic motor controller which safely avoids hazardous double activation of the directional valve in a simple way and which is formed integrally with the control lever bearing.

SUMMARY OF THE INVENTION

According to the present invention, a controller for a hydraulic motor comprises a directional valve (12) for communicating selectively pressure fluid from a pressure source (10) to a hydraulic motor (11) pilot pressure operated activating means (13, 14) associated with said directional valve (12); pilot valves (17, 18) connected to said activating means (13, 14) associated with said directional valve (12); a manually operable shifting device (15) mechanically connected to said directional valve (12) via a coupling means (24, 55, 56); a pressure operated actuating means (25, 47, 48) for shifting said coupling means (24, 55, 56) between an engaged condition and a disengaged condition; and a mode shifting valve (19) communicating with said pressure source (10) and also with said actuating means (25, 47, 48) and said pilot valves (17, 18), said mode shifting valve (19) being arranged to shift the controller from a first operation mode in which said actuating means (25, 47, 48) causes said coupling means (24, 55, 56) to occupy said engaged condition, and at the same time said pilot valves (17, 18) are disconnected from said pressure source (10), to a second operation mode wherein said coupling means (24, 55, 56) is shifted to said disengaged condition by said actuating means (25, 47, 48) and at the same time said pilot valves (17, 18) are connected to said pressure source (10).

BRIEF DESCRIPTION OF THE DRAWINGS

Preferred embodiments of the invention are described below with reference to the accompanying drawings in which.

DETAILED DESCRIPTION

Figure 1:
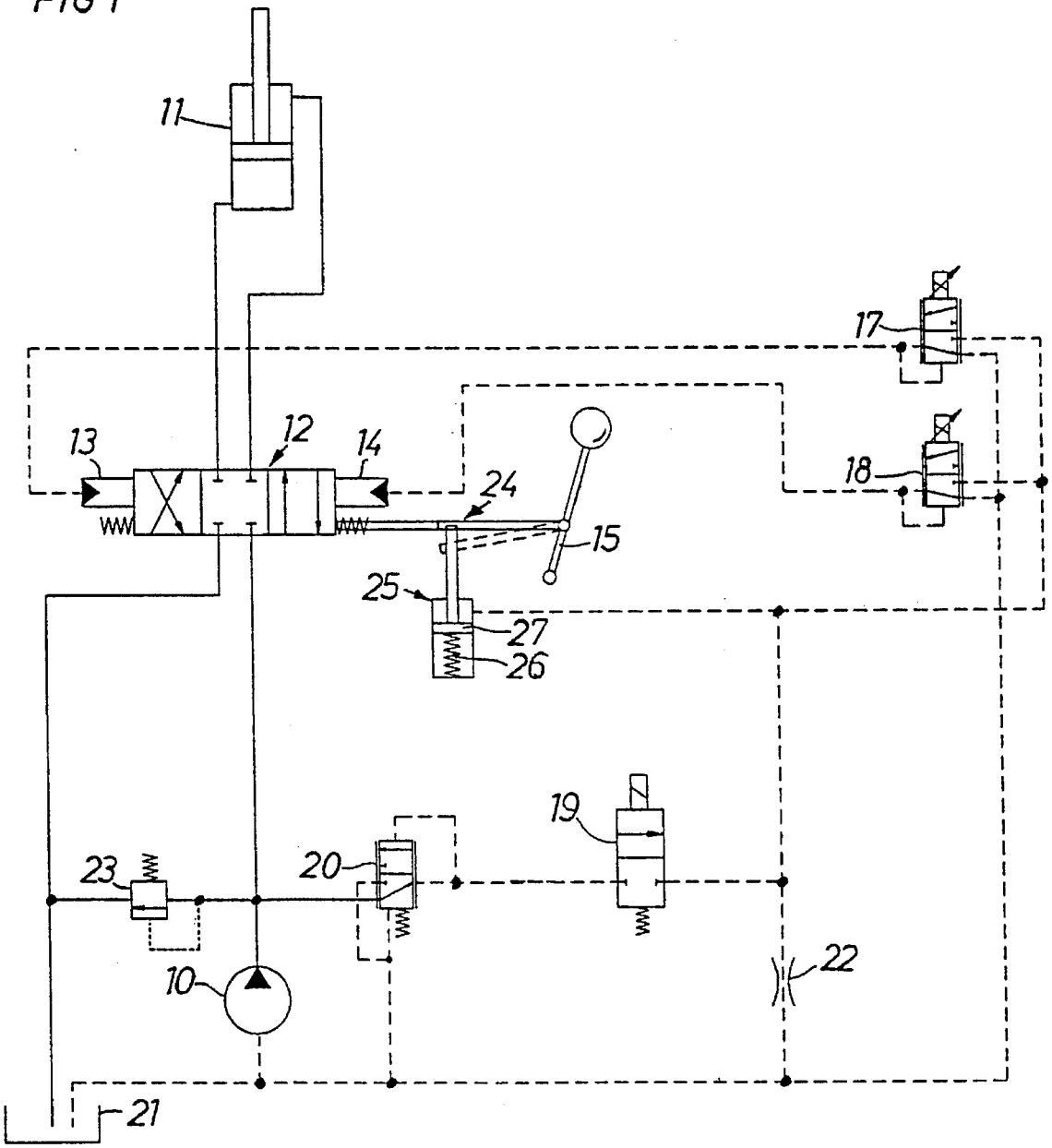
FIG. 1 shows schematically a controller according to the invention.

The control system shown in FIG. 1 is arranged to feed hydraulic fluid from a pump 10 to a motor 11 and comprises a directional valve 12 which is provided both with pilot pressure activating means 13, 14 and with a manually operable control lever 15.

The pilot pressure activating means 13, 14 are operated by fluid supplied via electromagnetic pilot valves 17, 18 which in turn are connected to the pump 10 via a mode shifting valve 19 and a constant pressure reduction valve 20. The latter also communicates with a tank 21 via a restriction 22. The system also includes a pressure controlled shunt valve 23 for connecting the output end of the pump 10 to the tank 21.

The control lever 15 is connected to the directional valve 12 by means of a coupling 24 which is shiftable between an engaged condition and a disengaged condition, illustrated by dash lines, by a pressure operated actuating means in the form of a single acting piston cylinder device 25. The latter includes a piston 27 and a spring 26 for biassing the piston 27 and the coupling 24 towards the engaged condition of the latter.

In operation, the fluid flow through the directional valve 12 to and from the motor 10 is controlled in either one of two alternative modes, namely by activation via the pilot pressure activating means 13, 14 or by operation of the lever 15. According to the first mentioned mode, the mode shifting valve 19 is opened to feed pressure fluid to the pilot valves 17, 18 as well as to the coupling 24 actuating device 25. Thereby, fluid pressure acts on the piston 27, and the coupling 24 is shifted to its disengaged condition against the load of the spring 26, which means that the control lever 15 is no longer connected to the directional valve 12.

Instead, the pilot pressure activating means 13, 14 may be pressurized by activation of the pilot valves 17, 18. Hazardous double activation of the directional valve 12 is now avoided in that the lever 15 is disconnected.

If a direct lever controlled operation of the directional valve 12 is desired, the mode shifting valve 19 is shifted to its closed position, wherein the pressure fluid feed to the pilot valves 17, 18 is interrupted as is the activation of the coupling 24 actuating device 25. The drain passage to the tank 21 via restriction 22 ensures that no pressure remains downstream of the mode shifting valve 19.

As the coupling 24 actuating device 25 is depressurized, the spring 26 shifts the coupling 24 to an engaged condition resulting in an interconnection of the directional valve 12 and the lever 15. In this operation mode of the control system, activation of the directional valve 12 can be carried out by the lever 15 only, and any accidental activation of the electromagnetic pilot valves 17, 18 would not cause any undesirable activation of the directional valve 12 since the pilot valves 17, 18 are disconnected from the pump 10.

Figure 3:
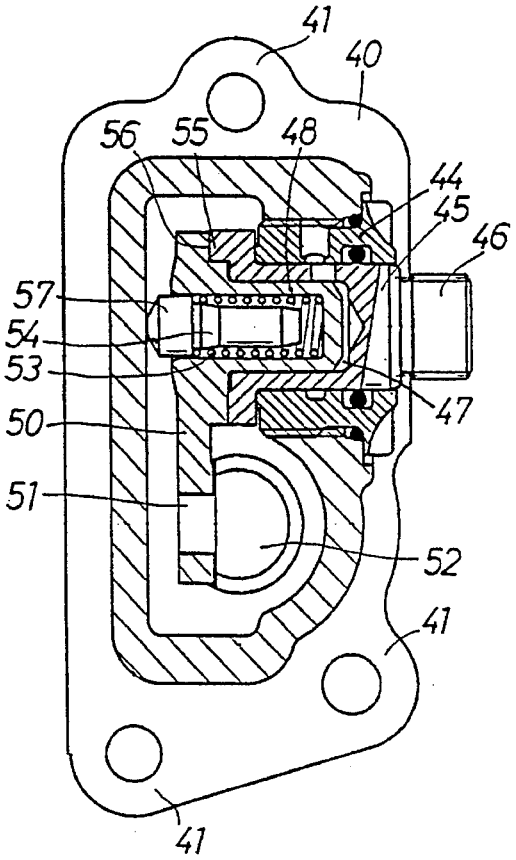
FIG. 3 shows a cross section along line III—III in FIG. 2.
Figure 2:
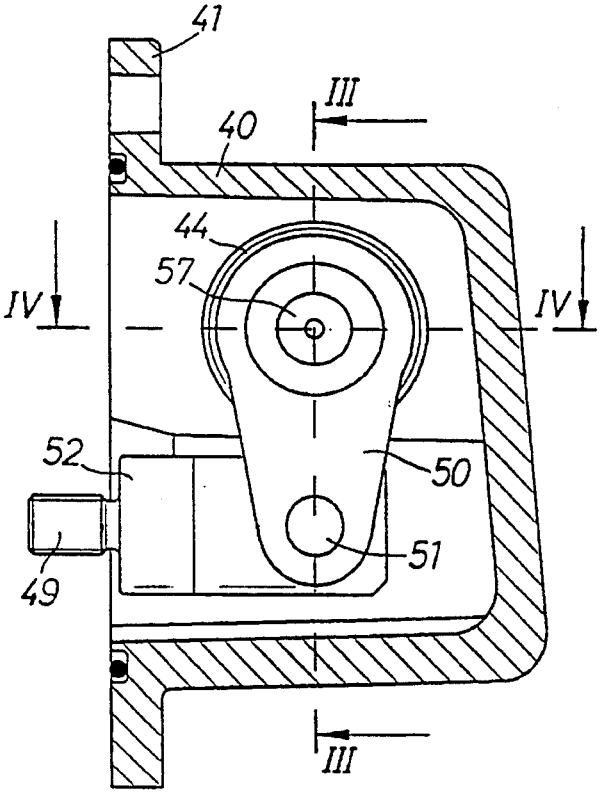
FIG. 2 shows, partly in section, a side view of a directional valve activating means according to the invention.
Figure 4:
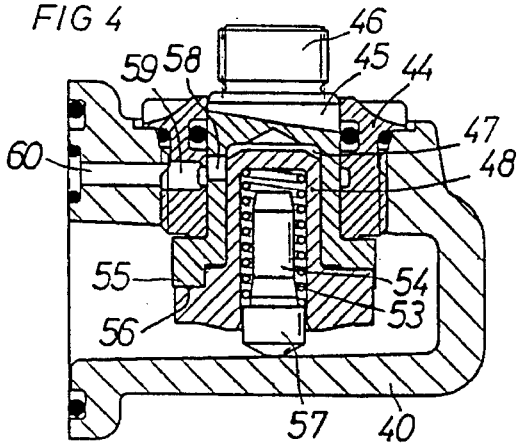
FIG. 4 shows a cross section along line IV—IV in FIG. 2.

In FIGS. 2 and 3, there is shown a directional valve activating unit which comprises a casing 40 formed with ears 41 for mounting screws, and a flat contact surface 42 for direct mounting on the directional valve housing (not shown). In the casing 40 there is mounted a bearing sleeve 44 in which is rotatively journalled a hollow spindle 45 formed with a threaded outer end portion 46 for attachment of the control lever 15.

The spindle 45 comprises a coaxial cylinder bore 47 in which is sealingly guided a cup shaped piston 48. The latter is formed integral with an arm 50 which by means of a transverse pin 51 engages a slotted spindle 52 connectable to the valve spindle of the directional valve by means of a threaded end portion 49.

A spring 53 supported on a dowel 54 exerts a biassing force on the piston 48 toward the spindle 45. The dowel 54 is formed with a head 57 which rests against the casing 40.

The spindle 45 is formed with a coupling dog 55 for torque transferring engagement with a corresponding recess 56 in the arm 50.

Through radial openings 58 and 59 in the spindle 45 and the mounting sleeve 44, respectively, pressure fluid may be fed into the cylinder bore 47 behind the piston 48 to accomplish an axial disengagement movement of the arm 50 in relation to the spindle 45, whereby the dog 55 is separated from the recess 56 and the lever 15 is disconnected from the directional valve 12.

Pressure fluid for this purpose is supplied via a connection opening 60 which communicates with a pressure fluid passage in the directional valve housing (not shown) which in turn communicates with the mode shifting valve 19. As the latter is reclosed, however, the cylinder bore 47 is depressurized and the coupling 55, 56 is reengaged by action of the spring 53. This means that the directional valve is again operable by the control lever 15.

We claim:

1. A controller for a hydraulic motor, comprising:

a directional (12) valve for communicating selectively pressure fluid from a pressure source (10) to a hydraulic motor;

pilot pressure operated activating means (13, 14) associated with said directional valve (12);

pilot valves (17, 18) connected to said activating means (13, 14);

a manually operable shifting device (15) mechanically connected to said directional valve (12) via a coupling means (24, 55, 56);

a pressure operated actuating means (25, 47, 48) for shifting said coupling means (24, 55, 56) between an engaged condition and a disengaged condition; and a mode shifting valve (19) communicating with said pressure source (10) and also with said actuating means (25, 47, 48) and said pilot valves (17, 18), said mode shifting valve (19) being arranged to shift the controller from a first operation mode in which said actuating means (25, 47, 48) causes said coupling means (24, 55, 56) to occupy said engaged condition, and at the same time said pilot valves (17, 18) are disconnected from said pressure source (10), to a second operation mode wherein said coupling means (24, 55, 56) is shifted to said disengaged condition by said actuating means (25, 47, 48) and at the same time said pilot valves (17, 18) are connected to said pressure source (10).

2. A controller according to claim 1, wherein said actuating means (25, 47, 48) comprises a single acting piston-cylinder device which includes a spring (26, 53) for biassing the piston (27, 48) of said piston-cylinder device (25, 47, 48) toward said engaged condition of said coupling means (24, 55, 56).

3. A controller according to claim 2, wherein said mode shifting valve (19) is arranged to connect simultaneously said piston-cylinder device of said actuating mean (25, 47, 48) and said pilot valves (17, 18) to said pressure source (10).

4. A controller according to claim 3, wherein said mode shifting valve (19) is arranged to disconnect simultaneously said piston-cylinder device of said actuating means (25, 47, 48) and said pilot valves (17, 18) from said pressure source (10).

5. A controller according to claim 2, wherein said mode shifting valve (19) is arranged to disconnect simultaneously said piston-cylinder device of said actuating means (25, 47, 48) and said pilot valves (17, 18) from said pressure source (10).

* * * * *